United States Patent [19]

Ratti

[11] 4,121,876

[45] Oct. 24, 1978

[54] TELESCOPIC GUIDE FOR DRAWERS IN PARTICULAR METAL DRAWERS

[75] Inventor: Mario Ratti, Bresso (Milan), Italy

[73] Assignee: S.U.S.T.A. S.p.A., Milan, Italy

[21] Appl. No.: 773,404

[22] Filed: Mar. 1, 1977

[30] Foreign Application Priority Data

Mar. 22, 1976 [IT] Italy ..... 21014/76[U]

[51] Int. Cl.[2] ..... F16C 21/00

[52] U.S. Cl. ..... 308/3.8; 312/330 R

[58] Field of Search ..... 308/3.6, 3.8, 6 R, 202, 308/203, 204, 207, 215; 108/143; 312/348, 330 R, 334

[56] References Cited

U.S. PATENT DOCUMENTS

| | | | |
|---|---|---|---|
| 2,859,070 | 11/1958 | Gomersall | 308/3.8 |
| 3,488,097 | 1/1970 | Fall | 312/348 X |
| 3,904,254 | 9/1975 | Hagen et al. | 308/3.8 |
| 4,037,885 | 7/1977 | Rock et al. | 308/3.8 |

*Primary Examiner*—Trygve M. Blix
*Assistant Examiner*—Douglas C. Butler
*Attorney, Agent, or Firm*—Wenderoth, Lind & Ponack

[57] ABSTRACT

A telescopic guide for metal drawers includes, on each of the opposite sides of a drawer, a pair of guideways, one secured to a piece of furniture and the other secured to the respective side of the drawer, and a rail-type intermediate element designed to slide on both of the guideways. Each intermediate element includes two single parallel rails designed to independently cooperate with the guideway of the piece of furniture and with the guideway of the drawer. Catches or stops are provided for the intermediate element to be pulled or pushed by the drawer.

3 Claims, 3 Drawing Figures

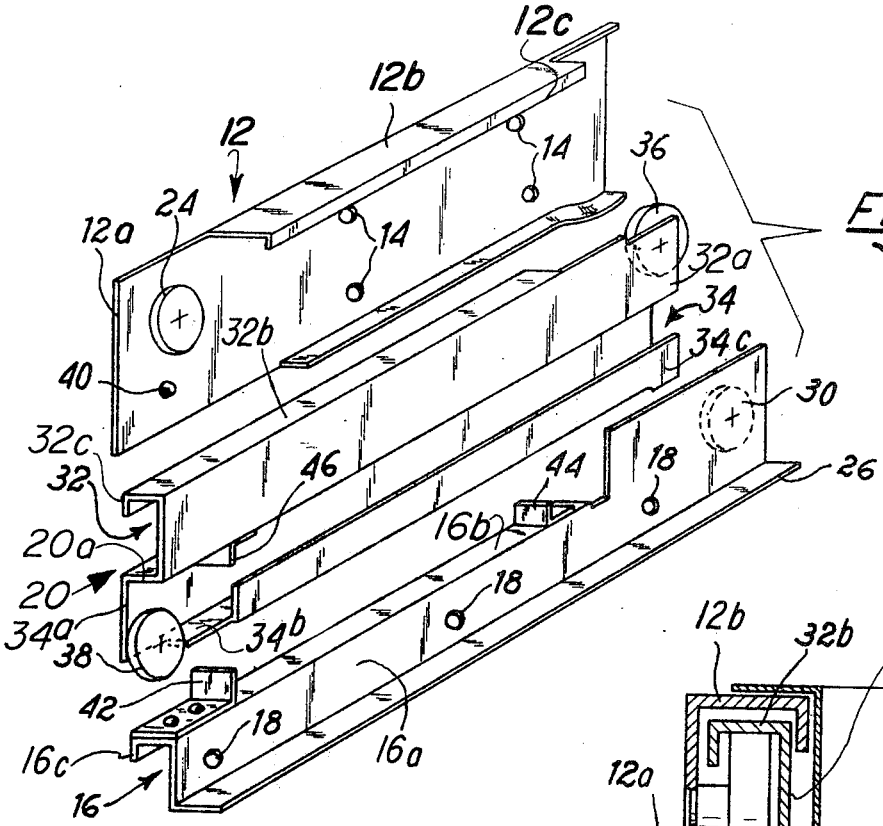
Fig. 1
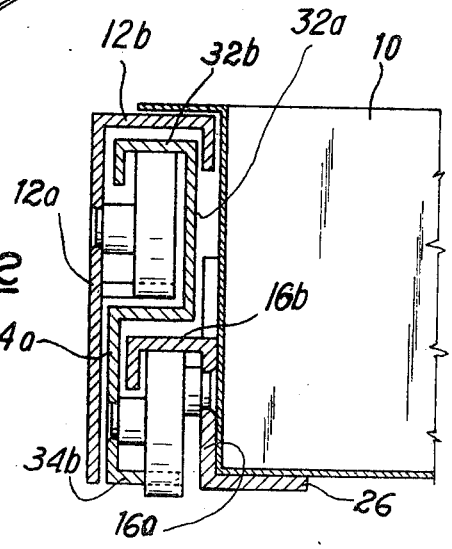
Fig. 2
Fig. 3
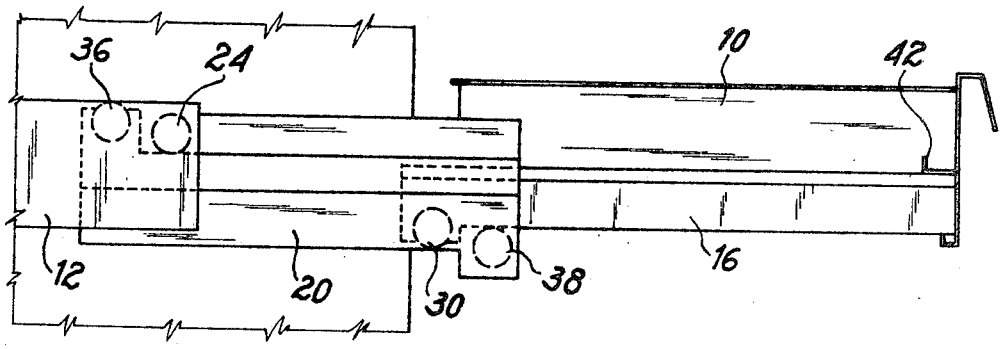

TELESCOPIC GUIDE FOR DRAWERS IN PARTICULAR METAL DRAWERS

BACKGROUND OF THE INVENTION

The present invention relates to a telescopic guide for drawers, particularly of the type that includes guideways secured to a piece of furniture on opposite sides of a drawer, guideways secured to the drawer, and rail-type intermediate elements on opposite sides of the drawer to slide on both guideways of the piece of furniture and of the drawer, respectively, by means of rollers or of bearings.

More particularly, the present invention relates to a drawer of the type mentioned above and having a novel and improved configuration and arrangement of components, such as to impart to the guide, and to a drawer associated therewith, a novel and greater usefulness, particularly from the viewpoints of structural and assembly simplifications, as well as the attainment of a greater useful capacity of the drawer, by using less of the space available in a piece of furniture for the guide.

As is already well known, metal drawers are provided with guides including guideways which are secured to a piece of furniture and to opposite sides of the drawer. The guideways form guide rails which slidingly engage with one another, e.g. by the interposition of bearings or rollers, to thereby ensure smooth motion of the drawer, even if the drawer is heavily loaded. Also as is well known, two types of guides are utilized, namely, plain guides, and telescopic guides, the latter having an intermediate guide rail on either side of the drawer, which is designed to cooperate with the guideway of the piece of furniture and with the guideway of the drawer.

Telescopic guides provide a high carrying capacity for the drawer, while also allowing a complete withdrawal thereof from the piece of furniture, which is however not possible with plain guides. In known telescopic guides, the intermediate element is advanced, through a set of bearings and compensating rollers, by the motion of the guideway of the drawer, whereby there occurs a coordinated shifting of both the movable guide rail of the drawer and of the intermediate element. This results however in structural complexity of the guides, in a bulky dimension thereof in a direction transverse of the drawer, and often also in the necessity of having the intermediate elements connected with one another on the sides of the drawer, thereby forming a frame structure by which the useful space of the drawer is decreased.

SUMMARY OF THE INVENTION

The object of the present invention is to provide a telescopic guide for drawers, in particular for metal drawers, by which the above disadvantages of known metal telescopic guides are prevented, or at least minimized, while maintaining or even improving the smooth sliding features of an even highly loaded drawer.

This object is achieved according to the invention by providing that the intermediate component is formed of two single parallel guide rails designed to independently cooperate with the guideway of the piece of furniture and with the guideway of the drawer. The intermediate component also has a stop so that it may be moved in opposite directions by the guideway of the drawer. The telescopic guide comprises the combination of two plain guides, one formed by cooperation between the guideway of the piece of furniture and the intermediate component, and the other formed by cooperation between the intermediate component and the guideway of the drawer. Moreover, sliding motion of the intermediate component along the guideway of the piece of furniture is achieved by the drawer and by its guideway, after completion of the sliding motion of the guideway of the drawer along the intermediate component.

In order to reduce as much as possible the crosswise or transverse size of the telescopic guide, the two plain guides and thus also the guide rails of the intermediate component, are advantageously located in vertically superposed positions. Thus, the intermediate component has an S-shaped configuration, with the openings of the two guide rails oppositely directed, i.e. one directed toward the guideway of the piece of furniture, and the other directed toward the guideway of the drawer. The two guideways are thus located at different vertical levels.

BRIEF DESCRIPTION OF THE DRAWINGS

An embodiment of the present invention will now be described in more detail with reference to the accompanying drawings, wherein:

FIG. 1 is an exploded perspective view of main components of a telescopic guide according to the invention.

FIG. 2 is a partial sectional view, taken in a plane perpendicular to sliding direction of the guide, showing the mutually engaged components of the guide.

FIG. 3 is a diagrammatic side view showing a drawer fitted with a telescopic guide according to the invention, in its fully pulled-out position.

DETAILED DESCRIPTION OF THE INVENTION

Referring now to the drawings, the guide essentially consists, on opposite sides of a drawer, of three components, i.e. a first guideway 12 designed to be secured to the body of a piece of furniture, e.g. by means of fasteners that pass through the openings 14, a second guideway 16 designed to be secured to the body of drawer 10, e.g. by fasteners extending through the openings 18, and finally an intermediate component 20 designed to cooperate with both guideways 12 and 16.

The guideway 12 essentially includes a single integral plate member having a first vertical portion **12*a* directly attached to a piece of furniture, a first planar horizontal portion 12*b* extending horizontally outwardly from the top of first vertical portion 12*a*, and a first retaining guide portion 12*c* extending vertically downwardly from the outer edge of first planar horizontal portion 12*b*. A first bearing, preferably a roller 24, is fitted near the forward end of first vertical portion 12*a* to rotate about a horizontal axis, and designed to cooperate with a corresponding recessed guide seat which is formed in the intermediate component 20. The guideway 16 includes a single integral plate member formed with a lower wing 26 that extends below the drawer 10, a second vertical portion 16*a* directly attached to drawer 10, a second planar horizontal portion 16*b* extending horizontally outwardly from the top of second vertical portion 16*a*, and a second retaining guide portion 16*c* extending vertically downwardly from the outer edge of second planar horizontal portion 16*b*. A second bearing, preferably a roller 30, is fitted on the rear end of second vertical portion 16*a*, to cooperate with a corresponding recessed guide seat of intermediate component 20**.

As will be noticed, in particular from FIGS. 1 and 2, intermediate component 20 includes a sectioned member having an essentially S-shaped cross-section, thereby defining two sliding recessed guide seats 32 and 34. Seat 32 is disposed vertically above seat 34, and seats 32 and 34 open on opposite sides of intermediate component 20, to cooperate with the guideway 12 of the piece of furniture and with the guideway 16 of the drawer 10, respectively. First guide seat 32 includes a third vertical portion 32*a*, a third planar horizontal portion 32*b* extending horizontally outwardly from the top of third vertical portion 32*a*, and a third retaining guide portion 32*c* extending vertically downwardly from the outer edge of third planar horizontal portion 32*b*. Second guide seat 34 includes a fourth vertical portion 34*a*, a fourth planar horizontal portion 34*b* extending horizontally outwardly from the bottom of fourth vertical portion 34*a*, and a fourth retaining guide portion 34*c* extending vertically upwardly from the outer edge of fourth planar horizontal portion 34*b*. A fifth planar horizontal portion 20*a* integrally connects the bottom of third vertical portion 32*a* with the top of fourth vertical portion 34*a*. A third bearing, preferably a roller 36, is mounted on the rear end of third vertical portion 32*a* to rotate about a horizontal axis. A fourth bearing, preferably a roller 38, is mounted on the forward end of fourth vertical portion 34*a* to rotate about a horizontal axis.

When the entire unit is wholly assembled, the third planar horizontal portion 32*b* slides on the roller 24, and the first planar horizontal portion 12*b* slides on the roller 36, thereby forming, between the guideway 12 of the piece of furniture and the intermediate component 20, a first so-called plain guide which is operable in such a manner that component 20 can slide relative to guideway 12. Moreover, the intermediate component 20 can be guided with respect to the guideway 12 in the lateral direction by means of a support 40 made of a material having a low friction coefficient.

Similarly, the intermediate component 20 is also connected with the guideway 16 since roller 30 rolls on fourth planar horizontal portion 34*b*, and the second planar horizontal portion 16*b* slides on the roller 38, thereby forming a second so-called plain guide which is located below the first plain guide, and which allows the drawer to slide on the intermediate component 20. In both plain guides, means are provided for defining the end-stroke positions of relative travel of the respective components.

Therefore, the telescopic guide of the invention as shown essentially includes the association of two superposed plainn guides that are defined by the interposition of intermediate component 20. To impart movement to component 20 upon movement of drawer 10, stops are suitably provided so that the intermediate component 20 is acted upon after the completion of relative movement between guideway 16 and component 20. Such stops may include stop 42 fitted on the guideway 16 and adapted to push against the outer edge of intermediate component 20 when pushing in the drawer, and by a pair of projections 44 and 46 on the guideway 16 and on the intermediate component 20, respectively, by the interaction of which component 20 is pulled out and the end-stroke position of drawer 10 is defined.

Due to the above described telescopic guide, the crosswise size thereof can be kept within relatively narrow limits, such size being substantially equal to that of a single plain guide, while at the same time obtaining unusually smooth sliding conditions of the different components.

While a specific form of the invention has been herein shown and described, various obvious changes may be made therein, e.g. for the adaptation to different operational and structural requirements, without departing from the spirit of the invention, as defined in the appended claims.

What we claim is:

1. A telescopic guide of the type to be positioned between opposite sides of a drawer and a piece of furniture so that the drawer may be slidingly pulled from and pushed into the piece of furniture, said telescopic guide comprising:

a first guideway comprising a single integral member including a first vertical portion adapted to be directly attached to the piece of furniture, a first planar horizontal portion extending horizontally outwardly from the top of said first vertical portion, and a first retaining guide portion extending vertically downwardly from the outer edge of said first planar horizontal portion;

a first roller mounted on the forward end of said first vertical portion to be rotatable about a horizontal axis;

a second guideway comprising a single integral member including a second vertical portion adapted to be directly attached to the drawer, a second planar horizontal portion extending outwardly from the top of said second vertical portion, and a second retaining guide portion extending vertically downwardly from the outer edge of said second planar horizontal portion;

a second roller mounted on the rearward end of said second vertical portion to be rotatable about a horizontal axis;

an intermediate component formed of a single integral member having a substantially S-shaped cross-sectional configuration, thereby forming a first recessed guide seat adapted to face said first guideway and a second recessed guide seat adapted to face said second guideway, said first guide seat being positioned vertically above said second guide seat, said first guide seat comprising a third vertical portion, a third planar horizontal portion extending outwardly from the top of said third vertical portion and a third retaining guide portion extending vertically downwardly from the outer edge of said third planar horizontal portion, said second guide seat comprising a fourth vertical portion, a fourth planar horizontal portion extending outwardly from the bottom of said fourth vertical portion, and a fourth retaining guide portion extending vertically upwardly from the outer edge of said fourth planar horizontal portion, and a fifth planar horizontal portion integrally connecting the bottom of said third vertical position with the top of said fourth vertical portion;

a third roller mounted on the rearward end of said third vertical portion to be rotatable about a horizontal axis;

a fourth roller mounted on the forward end of said fourth vertical portion to be rotatable about a horizontal axis; and said first and second guideways and said intermediate component being assembled such that said first roller rolls along the bottom surface of said third planar horizontal portion, said third roller rolls along the bottom surface of said first planar horizontal portion, said second roller rolls along the top surface of said fourth planar horizontal portion, and said fourth roller rolling on the bottom surface of said second planar horizontal portion.

2. A telescopic guide as claimed in claim 1, further comprising first stop means on said intermediate component, second stop means on said second guideway at a position adjacent the forward end of the drawer, and third stop means on said second guideway at a position adjacent the rearward end of the drawer, said first, second and third stop means extending into said second guide seat, such that when the drawer is pulled outwardly and said second guideway has reached an outer end position with respect to said intermediate component, said third stop means then abuts said first stop means so that further outward movement of the drawer and said second guideway causes said intermediate component to be pulled outwardly, and such that when the drawer is pushed inwardly and said second guideway has reached an inner end position with respect to said intermediate component, said second stop means then abuts said first stop means so that further inward movement of the drawer and said second guideway causes said intermediate component to be pushed inwardly.

3. A telescopic guide as claimed in claim 1, wherein said second vertical portion has at the lower portion thereof a wing member extending outwardly in a direction opposite to said second guide portion, said wing member forming means for attachment to the bottom of the drawer.

* * * * *